US005727117A

United States Patent [19]

Moscato

[11] Patent Number: 5,727,117

[45] Date of Patent: Mar. 10, 1998

[54] DEVICE FOR SAVING WATER AND ENERGY IN ELECTRIC WATER HEATERS

[76] Inventor: Giuseppe Moscato, via G. Carini, 25-00152 Rome, Italy

[21] Appl. No.: 492,042

[22] PCT Filed: Dec. 29, 1993

[86] PCT No.: PCT/IT93/00142

§ 371 Date: Jul. 21, 1995

§ 102(e) Date: Jul. 21, 1995

[87] PCT Pub. No.: WO95/18340

PCT Pub. Date: Jul. 6, 1995

[51] Int. Cl.[6] ..... A47J 27/00

[52] U.S. Cl. ..... 392/441; 392/451; 392/474; 137/597

[58] Field of Search ..... 392/451, 450, 392/485, 486, 465, 468, 471, 474, 475; 126/362, 374; 137/337, 340, 341, 597

[56] References Cited

U.S. PATENT DOCUMENTS 5,367,605 11/1994 Violi ..... 392/451
5,383,491 1/1995 Heilman ..... 137/597

FOREIGN PATENT DOCUMENTS 2229934 12/1974 France .
89379 5/1921 Switzerland .

*Primary Examiner*—Tu B. Hoang
*Attorney, Agent, or Firm*—Beveridge, DeGrandi, Weilacher & Young, LLP

[57] ABSTRACT

A device for saving water and energy is connected to an electric water heater either at the time of original manufacture or later adaption. The system of production of differentiated quantities of constant temperature of water. The device includes the use of hydrodeviators to control the level of the flow of water to and from the electric water heater. Attached to the system is a portion for the measuring of the water level within the water heater to prevent damage and to ensure the availability of hot water for users. The device also has a variety of necessary piping and conduits for the flow of water and/or air based on which position the hydrodeviators are set. The device allows for the connected water heater to produce water at a constant temperature even when there is a small daily water use.

7 Claims, 2 Drawing Sheets

DEVICE FOR SAVING WATER AND ENERGY IN ELECTRIC WATER HEATERS

FIELD OF THE INVENTION

The present invention concerns a device for saving water and energy and that may be applied to electric water heaters, for the production of differentiated quantities of constant temperature water, according to the requests.

BACKGROUND OF THE INVENTION

It is already known that the actual electric water heaters have a continuous hydraulic working so that, following the outlet of warm water, new cold water is let in and that lowers the temperature of the water. Of course said already existing water heaters show a considerable energy absorption, which is not corresponding to the saving requests, as they imply the heating of the whole liquid mass contained therein, even if only small quantities of warm water are to be used.

SUMMARY OF THE INVENTION

It is the aim of the present invention to transform a conventional water heater into a water heater also for small daily use, with water quantities all at the same chosen temperature with a consequent saving of water and energy.

The aim set forth is reached by means of the device according to the present invention, that is to be inserted between the connections of warm and cold water, existing on the water heaters, and the ducts toward use, mainly consisting of two electric hydrodeviators for closing and opening the water and air flow, and in an electric hydrovalve for opening and closing the water towards a level measurer provided with two minimum and maximum sensors from a water pump and from a small basin for the recollection of the water, so as to fill up the water heater even partially, according to the requests, and thus transforming an electric water heater also into a water heater for the small daily warm water use, adjusting the requested quantity by means of a level measurer.

The advantages of the device according to the present invention are many and evident:

- by applying the device according to the present invention to an already existing water heater, all the warm water inside said water heater may be used without adding new cold water, that would cool down the already heated water, and all the water is at a constant temperature;
- the existing water heater will be transformed in an electric water heater for all small daily use;
- as a consequence, a great saving of water and energy is achieved.

BRIEF DESCRIPTION OF THE DRAWINGS

The present invention will be described more in detail hereinbelow according to the enclosed drawings in which the different elements are shown.

DETAILED DESCRIPTION OF THE PREFERRED EMBODIMENTS

Figure 1:
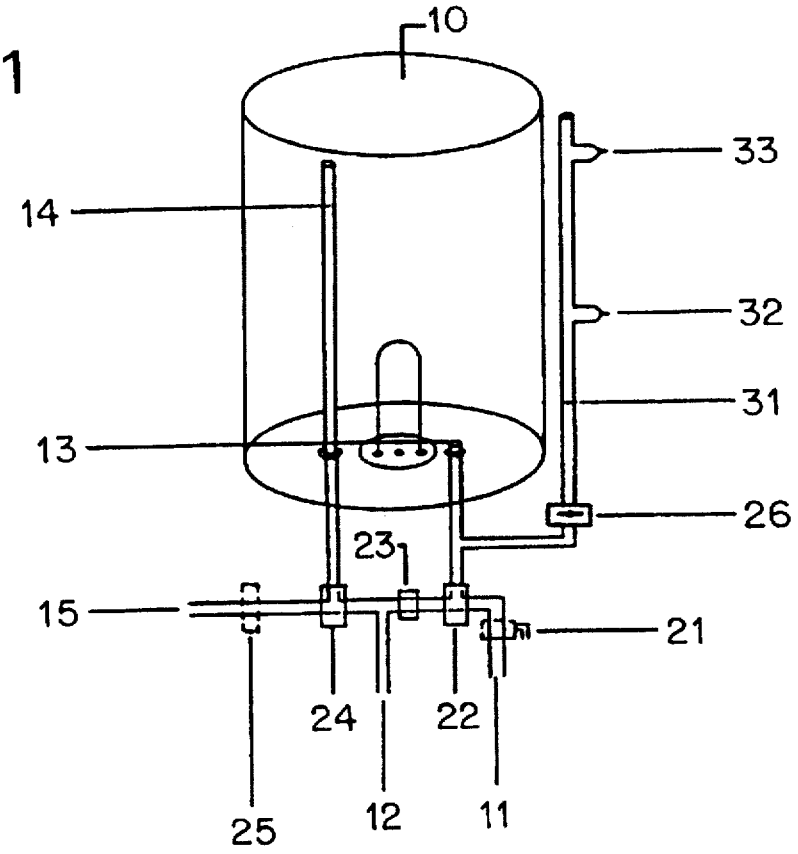
FIG. 1 shows a scheme of a device for saving water and energy according to the present invention, that may be applied to electric water heaters for the production of differentiated quantities of constant temperature water.
Figure 2:
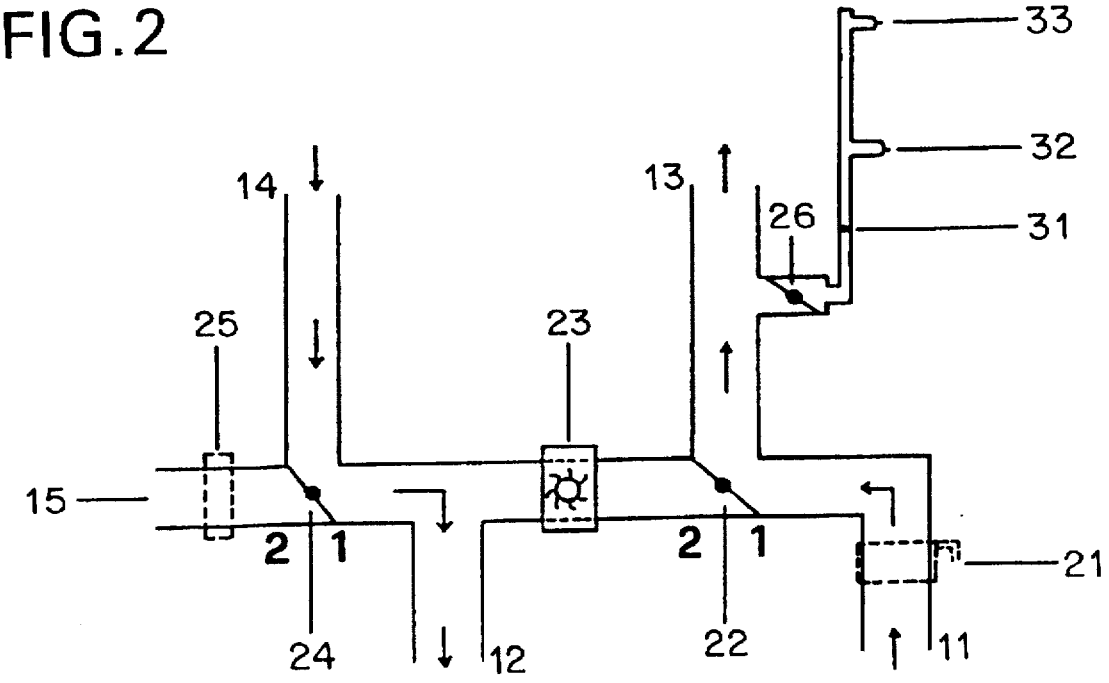
FIG. 2 shows the hydraulic scheme of the device according to the present invention, as shown in FIG. 1.
Figure 3:
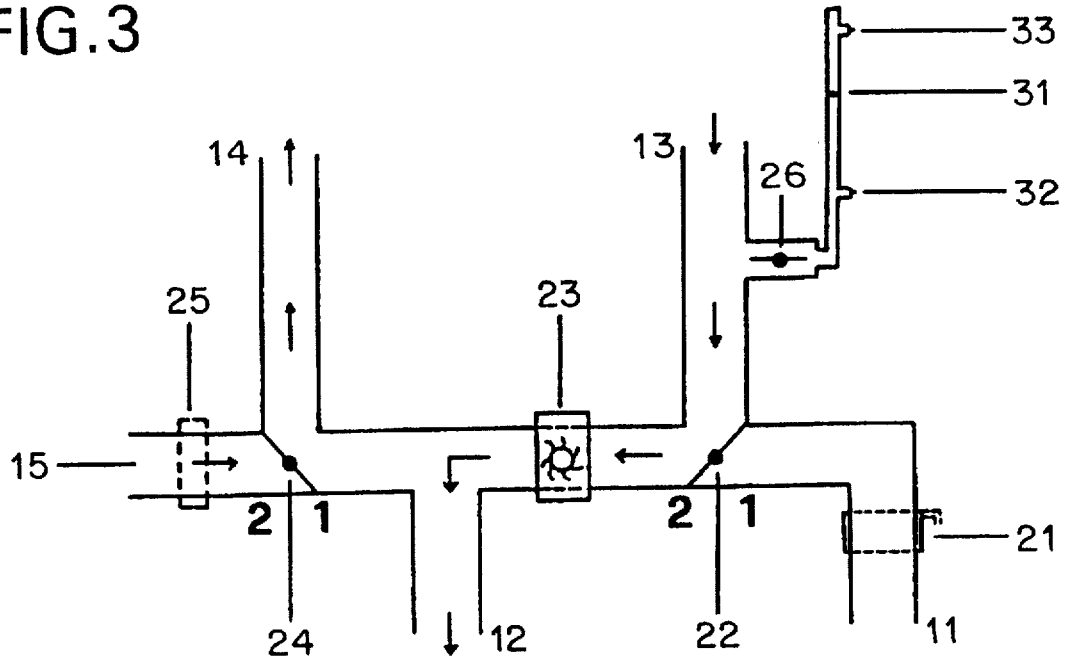
FIGS. 3 and 4 show the hydraulic schemes of the device according to the present invention in its different functioning phases.
Figure 4:
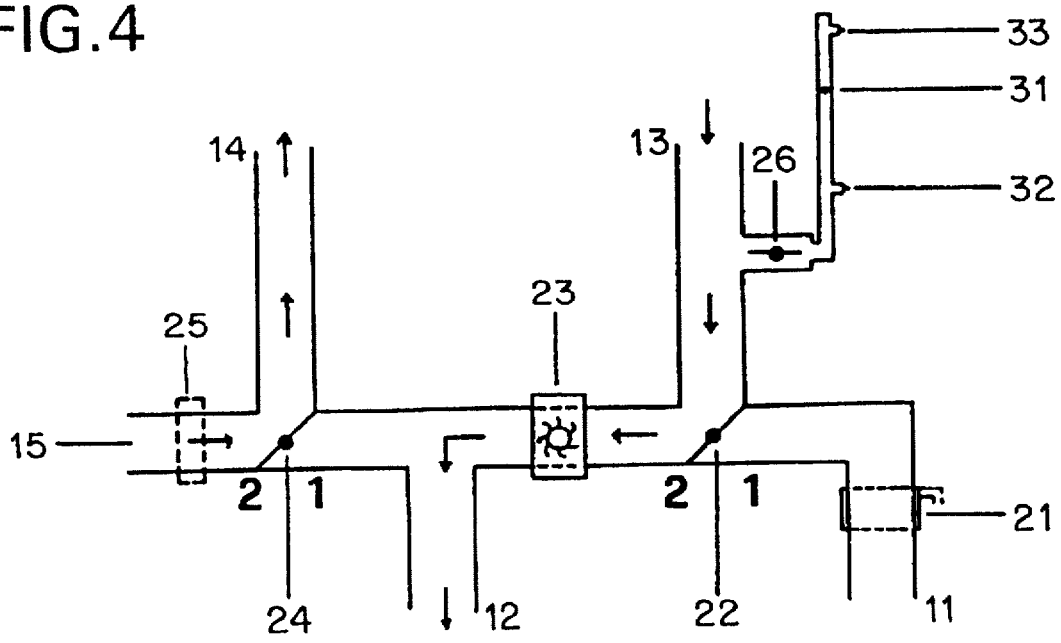

FIG. 1 shows the present invention attached to a electric water heater 10. FIGS. 2–4 show the invention in three different operating position combinations based on the location of the two electric hydrodeviators 22 and 24 and the electric hydrovalve 26.

The water to be heated in this system enters through a cold water duct 11 passing through a retaining valve 21. Cold water duct 11 is connected to an outlet duct 12 and a warm water tubing 13 through an electric hydrodeviator 22. An electric hydrodeviator 22 controls the flow of water to either run between the cold water duct 11 and the warm water tubing 13 or in a second position provides for a water flow from the warm water tubing 13 to the outlet duct 12.

The warm water tubing 13 has a branch to an electric hydrovalve 26 which provides a connection point to a water level measurer 31 which has two sensors 32 and 33. The first sensor is a maximum sensor 33 to determine when the water level is too high and then restricts the water flow into electric water heater 10 and to also close the electric hydrovalve 25 at this point. A second sensor is a minimum level sensor 32 to interrupt power if the water level becomes too low to prevent the heating element of the electric water heater 10 from burning out.

The outlet duct 12 provides a channel for the water to flow out of the electric water heater 10 and is connected to both electric hydrodeviators 22 and 24. The outlet duct 12 also passes through a pump 23 which is activated when the water flow from the warm water tubing 13 to the outlet duct 12 to provide an increase in the water pressure. The electric hydrodeviator 24 provides a connection point between the outlet duct 12, the cold water tubing 14, and an air return duct 15. The electric hydrodeviator 24 also has two positions for its operation, one of which allows for the passage of air into the electric water heater 10 to provide for a flow of water out of the electric water heater 10 to the outlet duct 12 and also to allow for a collection of residual water that exists in the cold water tubing 14 to collect in a small basin 25 which is mounted on the air return duct 15. A second position of the electric hydrodeviator 24 is to allow for water to flow from the cold water tubing 14 through the electric hydrodeviator to the outlet duct 12.

FIG. 2 shows the present system with both electric hydrodeviators 22 and 24 in a first position. When both of these electric hydrodeviators 22 and 24 are in the first position, the total or partial filling up of the electric water heater 10 under the normal operation parameters of conventional electric water heaters without the attached system. The water flow into the electric water heater 10 is determined through the cold water duct 11 by a retaining valve 21 into the warm water tubing 13 via the electric hydrodeviator 22.

FIG. 3 shows the electric hydrodeviator 22 in a second position, the electric hydrodeviator 24 in the first position, and the electric hydrovalve 26 in a open position. With the electric hydrovalve 26 in open position, the water level measurer 31 is able to provide for some control of the operation of the electric water heater 10 based on the water level detected by the maximum level sensor 33 and the minimum level sensor 32. If the maximum level sensor 33 detects that the water level has reached it, it will close the electric hydrovalve 26 to prevent an overflow from the water level measurer 31 and any damage that might result from this overflow. The minimum level sensor 32 detects when the water level has lowered to it. When the water level becomes low enough to activate the minimum level sensor 32, the power is interrupted to the heating element to prevent possible damage to the electric water heater 10 from possible overheating due to the lack of water within the electric water heater 10.

When the electric hydrodeviator 22 is in the second position, water is able to flow from the warm water tubing 13 through the electric hydrodeviator 22 through the pump 23 and into the outlet duct 12, which provides for the delivery of water to an user.

FIG. 4 shows both of the electric hydrodeviators 22 and 24 in the second position and the electric hydrovalve 26 in the open position. With the electric hydrodeviator 24 in the second position, air is able to enter from the air return duct 15 through the electric hydrodeviator 24 into the cold water tubing 14. This entry of air helps facilitate the water to flow from the warm water tubing 13 through the electric hydrodeviator 22 into the pump 23, which increases the water pressure to the user, and out to the user via the outlet duct 12. The air also allows for the small basin 25 to collect any water that remains within the cold water tubing 14. Also, with the electric hydrovalve 26 in the open position, the water level measurer 31 operates in a manner previously described.

The water level measurer 31 may be located either within or on the outside of the electric water heater. In addition, the water level measurer 31 may be either electrical or mechanical. The two sensors 32 and 33 may be internal or external to the water level measurer 31 with displays that are mechanical, electro-mechanical, electrical, hydraulic, or any other kind that would allow for the measuring of the water level. The display of the water level may be by any one of the following: hands, vertical tubing slit, electrical, or any other type that would provide for appropriate relaying of information.

The hydrodeviators 22 and 24 may also be internal or external to the electric water heater 10. The hydrodeviators 22 and 24 may be either electrical or mechanical. They may be computerized, manual, or mechanically operated and controlled. The hydrodeviators 22 and 24 may also be two individual components or grouped together in one single block, similar to a bathtub water configuration having a tap for the warm and cold water and a deviator for the shower. The hydrodeviators 22 and 24 may instead be hydrovalves or other related means used for opening and closing liquid ducts. The hydrodeviators 22 and 24 may be made from a variety of materials like metal, plastic, or some mixture of the two materials.

The electrical control circuit has not been described because it is well known to people skilled in the art. The control circuit may be realized by means of electrical or mechanical means. The control circuit may be computerized, time programmed, or mechanically controlled.

The present invention may be attached or installed in current electrical water heaters or may be assembled with newly manufactured electric water heaters.

Additional advantages and modifications will readily occur to those skilled in the art. Therefore, the invention and its broader aspects is not limited to the specific details, and representative devices, shown and described herein. Accordingly, various modifications may be made without departing from the spirit or the scope of the general inventive concept as defined by the appended claims and their equivalents.

I claim:

1. A device for saving water and energy that is connected to an electric water heater for production of differentiated quantities of constant temperature water, comprising:

a cold water duct, a retaining valve in said cold water duct, a first electric hydrodeviator connected to said cold water duct, said first electric hydrodeviator having a first position and a second position, an outlet water duct connected to said first electric hydrodeviator through a pump, said outlet water duct providing water to users, a warm water tubing connected to said first electric hydrodeviator and extending into said electric water heater, an electric hydrovalve connected to said warm water tubing, said electric hydrovalve having an open position and a closed position, a water level measurer connected to said electric hydrovalve, said water level measurer having a maximum level sensor and a minimum level sensor, a second electric hydrodeviator connected to said outlet water duct, said second electric hydrodeviator having a first position and a second position, a cold water tubing connected to said second electric hydrodeviator and extending into said electric water heater, an air return duct connected to said second electric hydrodeviator, and a small basin in said air return for the recollection of water.

2. A device for saving water and energy as recited in claim 1, wherein said first electric hydrodeviator and said second electric hydrodeviator are located outside said electric water heater.

3. A device for saving water and energy as recited in claim 1, wherein said electric water heater functions as a conventional electric water heater when said first electric hydrodeviator is in said first position, said second electric hydrodeviator is in said first position, and said electric hydrovalve is in said closed position; and whereby water flows through said cold water duct into said electric water heater.

4. A device for saving water and energy as recited in claim 1, wherein said electric water heater functions under control of said water level measurer when said first electric hydrodeviator is in said second position, said second electric hydrodeviator is in said first position, and said electric hydrovalve is in said open position; and whereby said water level measurer operates said maximum level sensor and said minimum level sensor to determine a level of water in said electric water heater, such that when said maximum level sensor detects the level of water, said maximum level sensor closes said electric hydrovalve, and when said minimum level sensor detects the level of water, said minimum level sensor interrupts power to said electric water heater.

5. A device for saving water and energy as recited in claim 1, wherein when said first electric hydrodeviator is in said second position, said second electric hydrodeviator is in said second position, and said electric hydrovalve is in said open position, then air flows from said air duct towards said cold water tubing causing residual water in said cold water tubing to collect in said small basin, said air also facilitating the flow of water from said warm water tubing, said flow of water from said warm water tubing passes through said first electric hydrodeviator to said outlet duct, by means of said pump, and said water level measurer measures a level of water in said electric water heater.

6. A device for saving water and energy as recited in claim 1, wherein said first electric hydrodeviator, said second electric hydrodeviator, and said electric hydrovalve are selected from a group of the following types: manual, computerized, or programmed by a timer.

7. Said device for saving water and energy as recited in claim 1, wherein said first electric hydrodeviator and said second electric hydrodeviator are joined in one package.

* * * * *